US006371697B2

(12) United States Patent
Huang et al.

(10) Patent No.: US 6,371,697 B2
(45) Date of Patent: Apr. 16, 2002

(54) FLOATING VESSEL FOR DEEP WATER DRILLING AND PRODUCTION

(75) Inventors: Edward Huang, Houston; Bambang A. Sarwono, Katy; Thomas W. Clapp, Houston, all of TX (US)

(73) Assignee: ABB Lummus Global, Inc., Houston, TX (US)

( * ) Notice: Subject to any disclaimer, the term of this patent is extended or adjusted under 35 U.S.C. 154(b) by 0 days.

(21) Appl. No.: 09/303,078

(22) Filed: Apr. 30, 1999

(51) Int. Cl.[7] ..... B63B 35/44

(52) U.S. Cl. ..... 405/224.2; 405/200; 405/223.1; 114/264

(58) Field of Search ..... 405/195.1, 196, 405/200, 203, 207, 205, 219, 223.1, 227, 227.2; 114/256, 264, 265, 260

(56) References Cited

U.S. PATENT DOCUMENTS

| | | | | |
|---|---|---|---|---|
| 3,360,810 A | | 1/1968 | Busking | 9/8 |
| 3,472,032 A | * | 10/1969 | Howard | |
| 3,572,041 A | | 3/1971 | Graaf | 61/46.5 |
| 3,760,875 A | | 9/1973 | Busking | 166/5 |
| 3,778,854 A | | 12/1973 | Chow | 9/8 |
| 3,824,795 A | * | 7/1974 | Mo | 405/207 |
| 3,879,952 A | * | 4/1975 | Mo | 405/207 |
| 3,889,476 A | | 6/1975 | Gerin | 61/46 |
| 4,043,138 A | * | 8/1977 | Stageboe et al. | 405/205 |
| 4,060,995 A | * | 12/1977 | Lacroix et al. | 405/207 |
| 4,098,333 A | | 7/1978 | Wells et al. | 166/5 |
| 4,181,453 A | | 1/1980 | Vache | 405/203 |
| 4,470,723 A | * | 9/1984 | Michel et al. | 405/205 |
| 4,473,323 A | | 9/1984 | Gregory | 405/224 |
| 4,626,137 A | * | 12/1986 | Willemsz | 405/205 |
| 4,702,321 A | | 10/1987 | Horton | 166/350 |
| 4,913,238 A | | 4/1990 | Danazcko et al. | 166/350 |
| 4,934,871 A | | 6/1990 | Kazokas, Jr. | 405/224 |
| 4,966,495 A | | 10/1990 | Goldman | 405/224 |
| 4,983,073 A | | 1/1991 | Petty et al. | 405/224 |
| 5,330,293 A | | 7/1994 | White et al. | 405/211 |

(List continued on next page.)

*Primary Examiner*—David Bagnell
*Assistant Examiner*—Frederick L. Lagman
(74) *Attorney, Agent, or Firm*—Shawn Hunter; Bracewell & Patterson, LLP

(57) ABSTRACT

An exemplary floatable vessel is described having an upper tower section with a reduced diameter or width and an affixed lower base section having an enlarged diameter or width. The lower section contains weighted ballast distributed upon its lower floor. The lower section also includes flotation tanks which can be filled with air to raise the vessel in the water such that portions of the lower section are raised above the water line. Alternatively, the flotation tanks can be flooded to dispose the lower section and a portion of the upper section below the water level. The upper tower section of the vessel supports a deck structure upon which rig components can be constructed or secured. The tower section includes flotation tanks as well. In preferred embodiments, these tanks are variable tanks that can be partially filled with air and partially flooded with water. The vessel defines a central chamber within which drilling risers are contained and suspended from the deck structure of the vessel downward toward the sea floor. One or more pneumatic supports are provided which assist in securing the riser and absorbing energy from movement of the platform. The floating vessel can be constructed and transported in a upright or vertical orientation so that it does not need to be upended prior to mooring at its intended location. In addition, structures such as rig components may be placed atop the tower portion prior to or during transportation of the vessel. During transportation by towing, the flotation tanks of the lower section are filled with air so that the lower section is partially raised above the surface of the water. The vessel is placed into its installed position by flooding the flotation tanks of the lower section to cause the lower section to become submerged.

23 Claims, 7 Drawing Sheets

U.S. PATENT DOCUMENTS

| | | | | |
|---|---|---|---|---|
| 5,381,865 | A | 1/1995 | Blandford | 166/344 |
| 5,421,676 | A | 6/1995 | Wybro et al. | 405/223.1 |
| 5,439,060 | A | 8/1995 | Huete et al. | 166/367 |
| 5,439,321 | A | 8/1995 | Hunter | 405/195.1 |
| 5,447,392 | A | 9/1995 | Marshall | 405/224.4 |
| 5,480,265 | A | 1/1996 | Marshall | 405/224 |
| 5,480,266 | A | 1/1996 | Marshall et al. | 405/224.2 |
| 5,551,802 | A | 9/1996 | Wybro | 405/223.1 |
| 5,558,467 | A | 9/1996 | Horton | 405/195.1 |
| 5,567,086 | A | 10/1996 | Huete | 405/223.1 |
| 5,584,607 | A | 12/1996 | de Baan | 405/224 |
| 5,588,781 | A | 12/1996 | Smolinski et al. | 405/195.1 |
| 5,609,442 | A | 3/1997 | Horton | 405/206 |
| 5,642,966 | A | 7/1997 | Morrison et al. | 405/195.1 |
| 5,706,897 | A | 1/1998 | Horton, III | 166/359 |
| 5,722,797 | A | 3/1998 | Horton, III | 405/224 |
| 5,775,845 | A | 7/1998 | Wybro | 405/195.1 |
| 5,791,819 | A | 8/1998 | Christiansen | 405/224 |
| 5,833,397 | A | 11/1998 | Horton, III | 405/204 |

* cited by examiner

FLOATING VESSEL FOR DEEP WATER DRILLING AND PRODUCTION

BACKGROUND OF THE INVENTION

1. Field of the Invention

The present invention relates to floating vessels used for offshore drilling and production of petroleum.

2. Description of the Related Art

Petroleum production often requires the placement of rig in an offshore location. In shallower waters, the rigs and production facilities can be placed on freestanding offshore platforms. As the water becomes deeper, however, these become impractical, and it is necessary to have a floating platform, or support vessel, upon which the rigs and production facilities can be placed.

One type of deepwater support vessel is the tension leg platform (TLP). The TLP is a buoyant platform that is secured to the seabed using generally vertically-oriented rigid tethers or rods that restrain the platform against vertical and horizontal motion relative to the well in the seabed below. Thus, these platforms have a very short period in response to wave action.

An alternative to the TLP is the deep draft caisson vessel (DDCV). The DDCV is a free floating vessel which is moored to the seabed using flexible tethers so that vertical and horizontal motion of the vessel is restrained, although not eliminated. Examples of DDCVs are found in U.S. Pat. No. 4,702,321.

Methods for restraining the DDCVs attempt to slow, rather than eliminate, the natural response period of the vessel to wave effects. Current DDCV arrangements "decouple" the vessel from the individual wells being supported so that the wells are not subject to the same induced motions as the vessel. Decoupling is typically accomplished by using buoyant means to make the wells separately freestanding and using flexible hoses to interconnect the vertical risers from the well to the production facilities.

A common variety of DDCV is the type shown in U.S. Pat. No. 4,702,321 that utilizes a long cylindrical structure and is commonly known as a spar. The long cylindrical shape of the spar provides a very stable structure when the vessel is in its installed position that exhibits very slow pitch surge and heave motions. Heave motion, however, is not totally eliminated, allowing the structure to bob up and down vertically in the sea. Recently, attempts have been made to add a number of horizontally extending plates along the length of the spar in order to help the spar be more resistant to heave.

Regardless of the presence of the plates, the spar must be assembled and transported in a horizontal position and then installed by being upended at or near the final site using a large crane that must also be transported to the installation site. As these caisson structures are often around 650 ft. in length, transport and, particularly upending, of the structure are risky. Further, it is only after a successful upending of the structure has occurred, and the lower portion of the structure has been successfully moored, that components of the rig can be placed atop the spar.

What is needed is a floating vessel which provides reduced motions and slow natural response periods to heave, but also can be assembled and transported in a vertical, or upright, orientation. A vessel of this type would permit rig components and other structures to be placed atop the vessel prior to or during transport.

SUMMARY OF THE INVENTION

The present invention provides an improved floating vessel that is capable of being moored by tethers to the sea floor. The vessel has an upper tower section with a reduced diameter or width and an affixed lower base section having an enlarged diameter or width.

The lower section contains ballast distributed upon its lower floor. The lower section also includes flotation tanks which can be filled with air to raise the vessel in the water such that portions of the lower section are raised above the water. Alternatively, the flotation tanks can be flooded to dispose the lower section and a portion of the upper section below the water level.

The upper tower section of the vessel supports a deck structure upon which rig components can be constructed or secured. The tower section includes flotation tanks as well. In preferred embodiments, these tanks are variable tanks that can be partially filled with air and partially flooded with water.

The vessel defines a central chamber within which drilling risers are contained and suspended from the deck structure of the vessel downward toward the sea floor. One or more supports are provided which assist in securing the riser and absorbing energy from movement of the platform.

The floating vessel can be constructed and transported in a upright or vertical orientation so that it does not need to be upended prior to mooring at its intended location. In addition, structures such as rig components may be placed atop the tower portion prior to or during transportation of the vessel. During transportation by towing, the flotation tanks of the lower section are filled with air so that the lower section is partially raised above the surface of the water. The vessel is placed into its installed position by flooding the flotation tanks of the lower section to cause the lower section to become submerged.

DETAILED DESCRIPTION OF THE PREFERRED EMBODIMENTS

FIGS. 1–4 depict an exemplary floating vessel 10 which supports a rig platform 12. The rig platform 12 may have constructed upon it mechanical equipment, support buildings, and other devices and facilities used for or associated with the production of and/or drilling for oil and gas.

Figure 3:
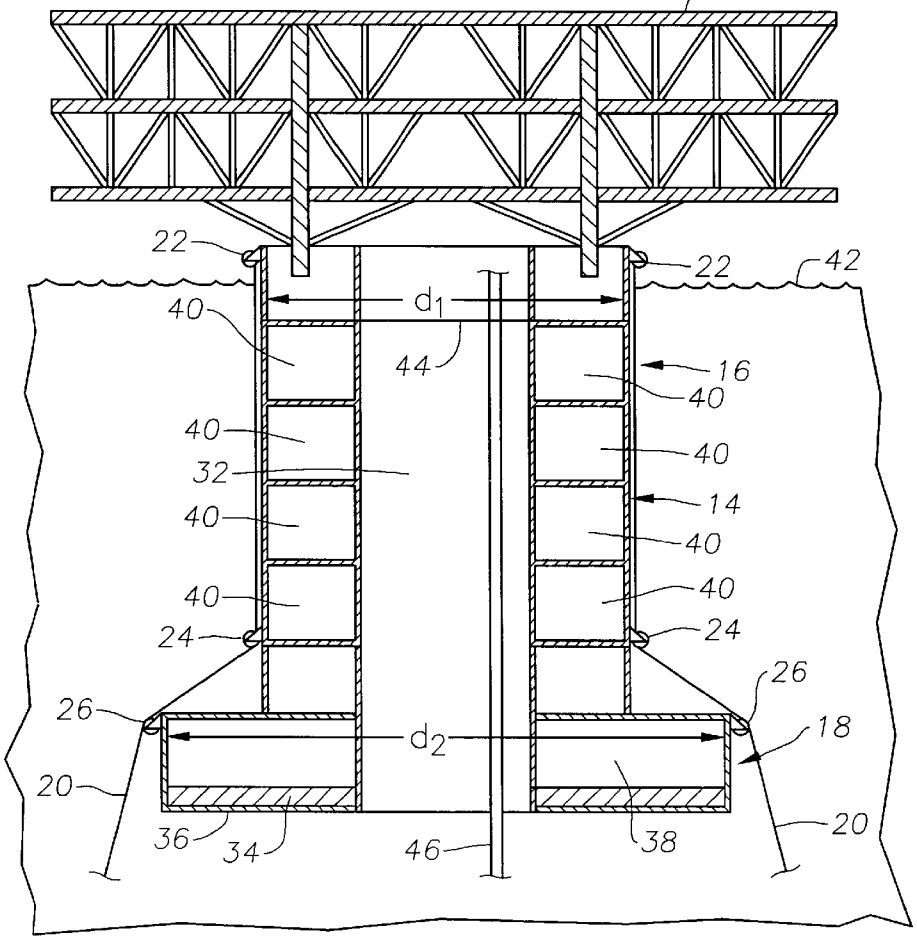
FIG. 3 is a cutaway cross-section of the floating vessel shown in FIGS. 1 and 2.

The vessel 10 has an outer hull 14 and is primarily made up of an upper tower section 16 and a lower base section 18. The tower section 16 provides a platform at its upper end upon which the rig platform 12 is secured and based. As best shown in FIG. 3, a plurality of mooring lines 20 are secured at anchors 22 located approximate the upper end of the tower section 16. The mooring lines 20 extend through eyelets 24 on the tower section 16 and eyelets 26 on the base section 18 and are then secured in a manner known in the art to the sea floor 28 by anchors 30. It is noted that the eyelets 26 are disposed upon the diametrical exterior of the base section 18. As a result, the vessel 10 is held in a more stable manner by the mooring lines 20.

As is apparent from the drawings, and especially FIG. 3, the tower section 16 has a diameter $d_1$, that is smaller than the diameter $d_2$ of the base section 18. In a presently preferred embodiment, the diameter $d_1$ of the tower section 16 is from 145 feet to 155 feet while the diameter $d_2$ of the base section 18 is from 255 feet to 275 feet. It should be understood, however, that these dimensions are not intended to be limiting and that other dimensions may be used as required by the equipment to be supported and the sea conditions within which the vessel is to be used.

Referring to FIG. 3, a central interior chamber 32 can be seen to be defined centrally within the vessel 10. The lower base portion 18 of the vessel 10 contains weighted ballast 34 horizontally distributed in an even manner along its lower floor 36. The horizontal distribution of the weighted ballast 34 provides added mass moment of inertia which serves to reduce pitch motions. The weighted ballast 34 preferably comprises iron ore ballast, although other ballast suitable for weighting the structure can be used.

Lower flotation tanks 38 are located above the ballast 34 in the base section 18. The lower flotation tanks 38 are provided with fittings or valves (not shown) which permit the tanks to be filled with air or, alternatively completely flooded with water as desired.

The tower section 16 of the vessel 10 also includes upper flotation tanks 40 substantially all along its length. The upper flotation tanks 40 are preferably variable pressure tanks and fittings (not shown) which permit the tanks to be partially filled with water and partially filled with air so that the amount of buoyancy provided by the tanks 40 is adjustable.

The elongated shape of the upper tower section 16 ensures that the vessel 10 is stable and resists pitch and roll forces. Further, the fact that the upper section 16 presents a reduced diameter or width limits the effective area that is exposed to wave action at or near the surface 42 of the water. Although the tower section 16 has an elongated shape, its length can be shorter than that of a standard spar due to the presence of the diametrically enlarged base section 18.

The radial enlargement of base portion 16 provides resistance to heave so that the vessel 10 has a low heave response. When placed in its installed configuration, the vessel 10 has a draft of about 250 feet or less.

Figure 5:
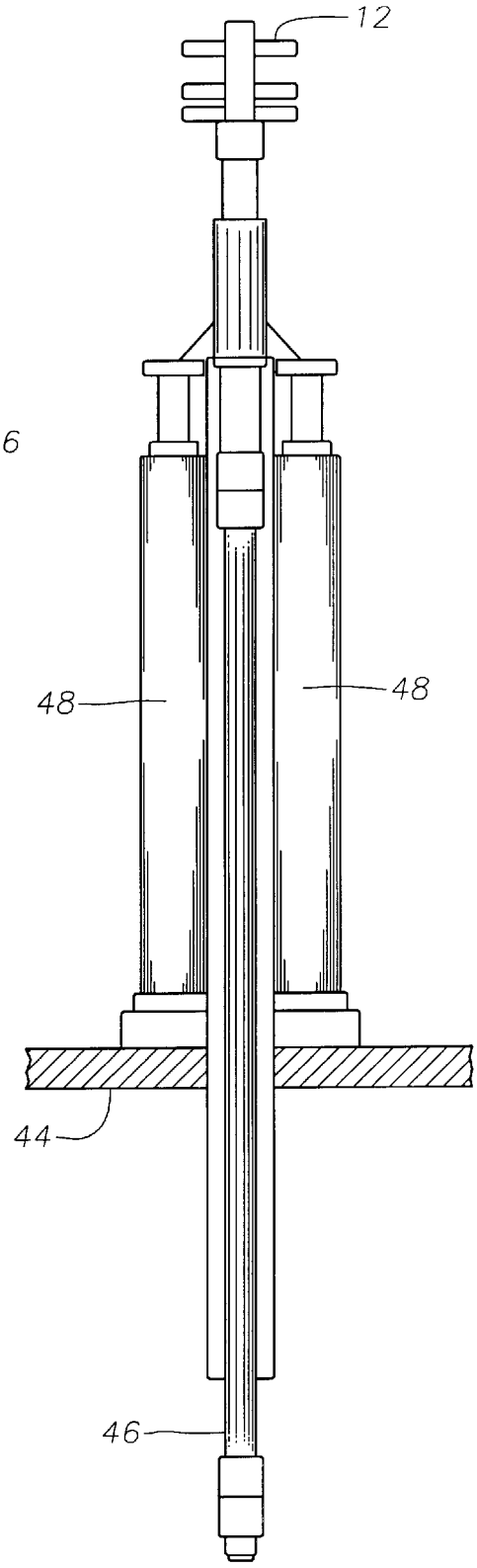
FIG. 5 illustrates an exemplary securing bracket used for securing riser within the vessel.
Figure 5A:
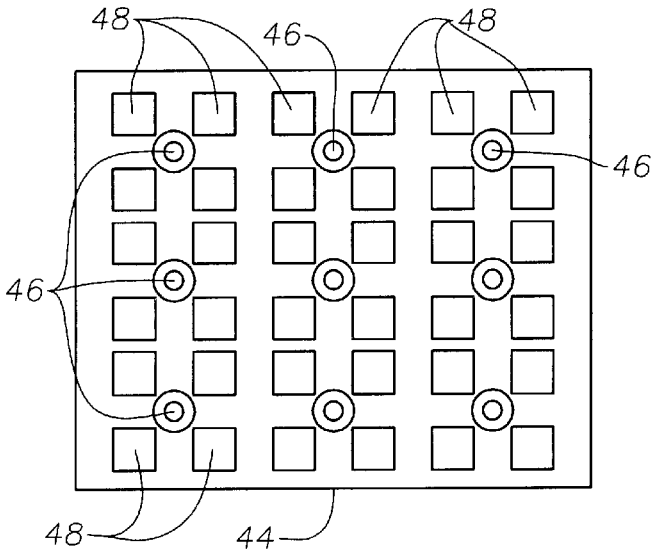

FIG. 3 shows a support platform 44 located below the rig platform 12, the structure and operation of which are better understood by reference to FIGS. 5 and 5A. An exemplary riser 46 is shown in FIG. 3 to be contained within the central chamber 32 and extends through the support platform 44. It will be understood by those of skill in the art that while one riser 46 is shown in FIG. 3, there are typically a number of such risers contained within the chamber 32. It will also be understood that the riser 46 extends upward to the rig platform 12 where it is operably associated with a blowout preventer, production equipment, and other equipment. However, since such arrangements are well known in the art, they are not described herein. It should also be understood that the central chamber 32 and support platform 44 could be used to contain and support drill strings or other equipment. FIGS. 5 and 5A illustrate in greater detail the association of the riser 46 with the support platform 44. The riser 46 passes through the support platform 44 and is moveably affixed to the platform 44 by a number of telescopic hydraulic or pneumatic motion dampeners 48 which help absorb the energy imparted to the vessel 10 by wave action.

Figure 6:
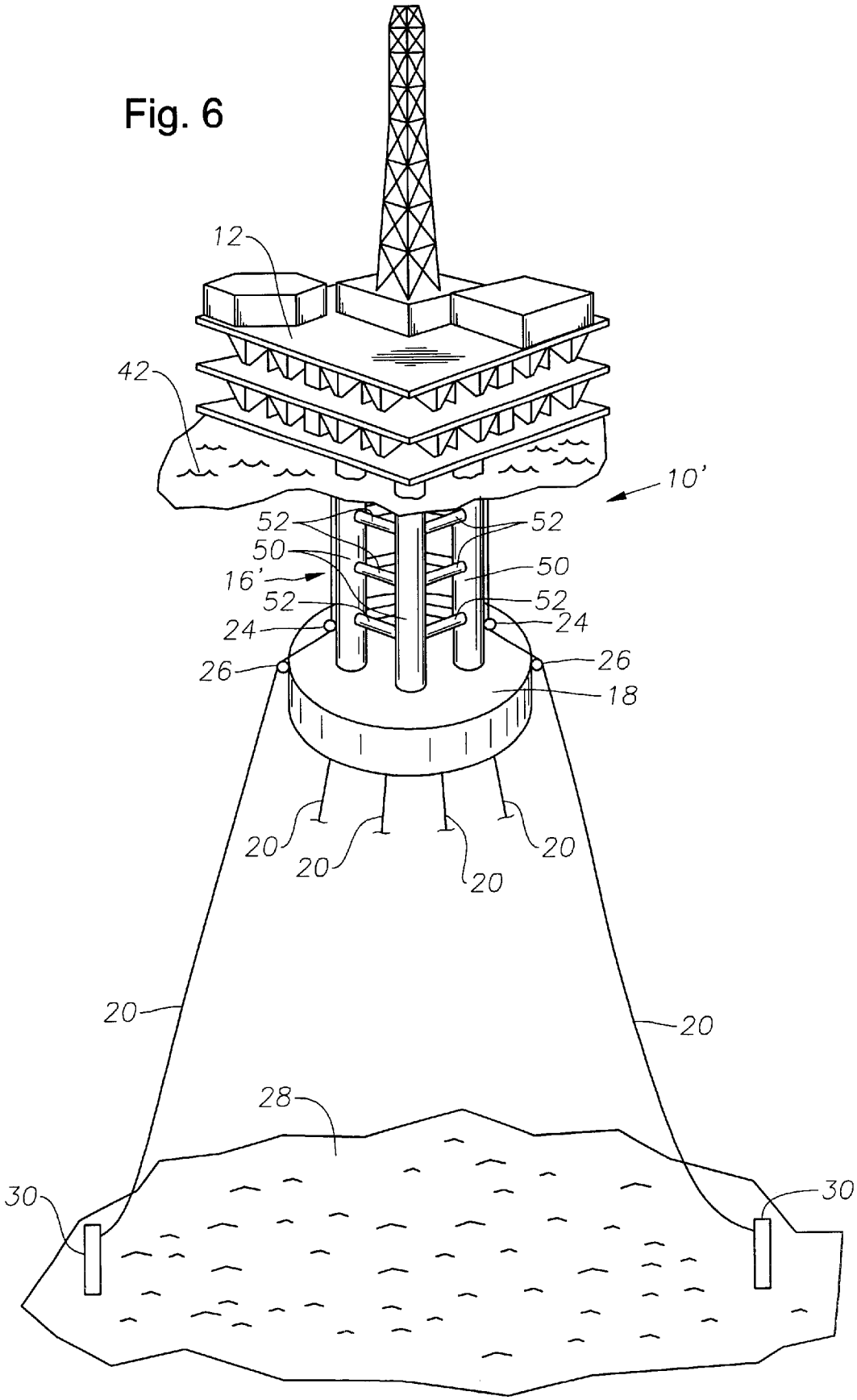
FIG. 6 depicts an exemplary alternative embodiment wherein the floating vessel has an upper portion formed of multiple columns.

Referring now to FIG. 6, an alternative embodiment is depicted for an exemplary floating vessel 10'. For simplicity, like components between this vessel and the vessel 10 described earlier have like reference numerals. The vessel 10' presents a tower portion 16' that is formed from a number of vertically disposed support columns 50 which are braced with cross members 52. Although not shown in FIG. 6, it will be understood that the columns 50 contain flotation tanks that are analogous to the upper flotation tanks 40 described with respect to the vessel 10. Also, the tower section 16 may be formed of crosssection shapes other than the cylindrical shape used in vessel 10. Suitable shapes include a polygon, if desired.

Figure 4:
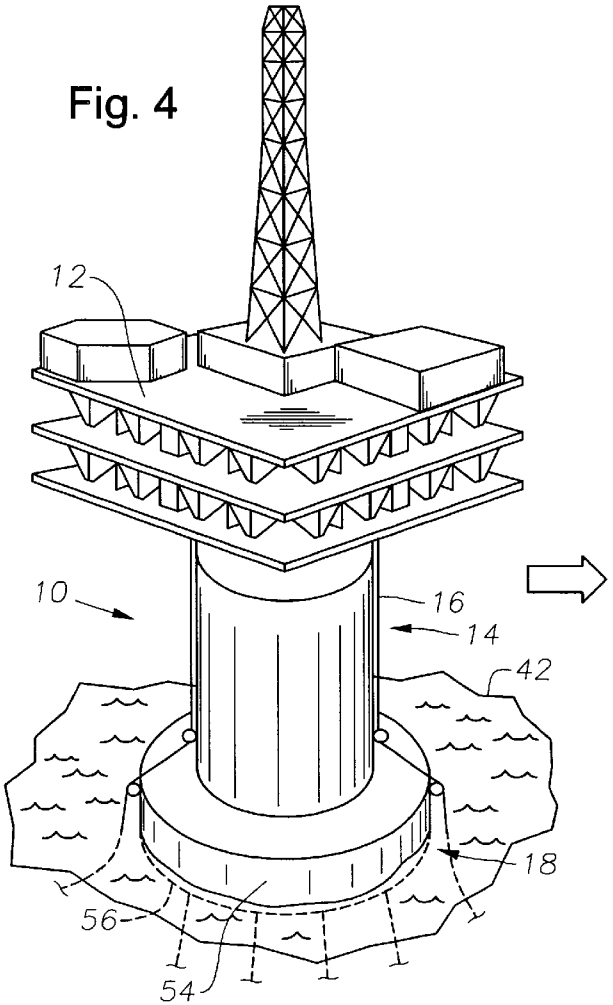
FIG. 4 depicts the arrangement of the floating vessel during transportation by towing.

In operation, the vessel 10 (or 10') is capable of being converted between a towing, or transport, configuration and an installed configuration. The towing configuration is illustrated by FIG. 4 which shows the vessel 10 disposed within the sea so that the tower section 16 and a portion 54 of the base section 18 are located above the surface 42 of the water. A submerged portion 56 of the base section resides below the surface 42. The towing configuration is achieved by filling the lower flotation tanks 38 with air so that the vessel is raised within the water substantially as shown in FIG. 4.

The vessels 10, 10' are moveable by direct towing in the upright, transport configuration by tugboats or other vessels (not shown). A vessel 10, 10' may also be placed aboard a barge (not shown) for transport. Spiral strakes 60 (shown in FIG. 1) may be affixed to the outer cylindrical sides of the tower section 16 in order to reduce vortexing in the surrounding fluid.

Figure 1:
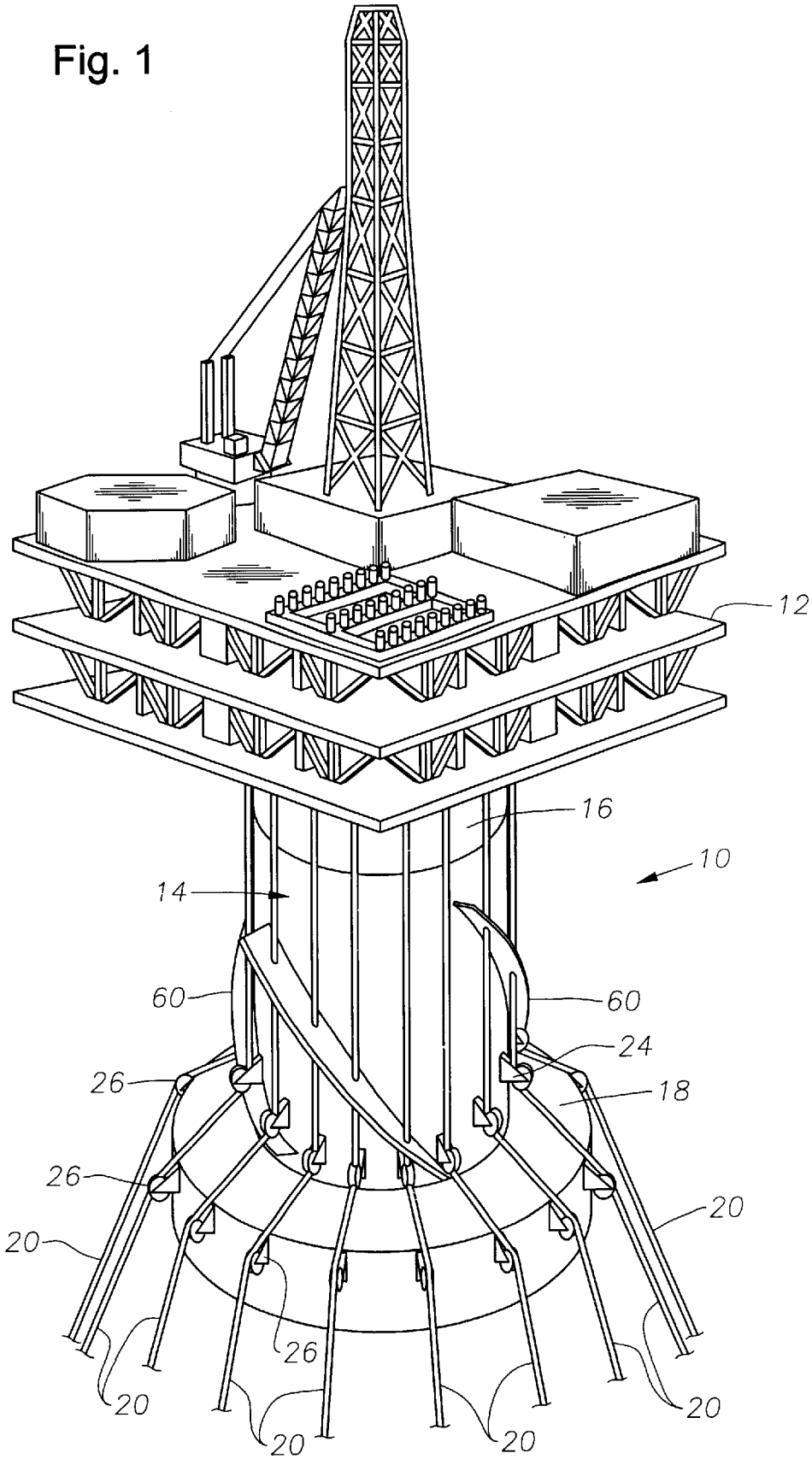
FIG. 1 is a perspective view of an exemplary floating vessel constructed in accordance with the present invention.
Figure 2:
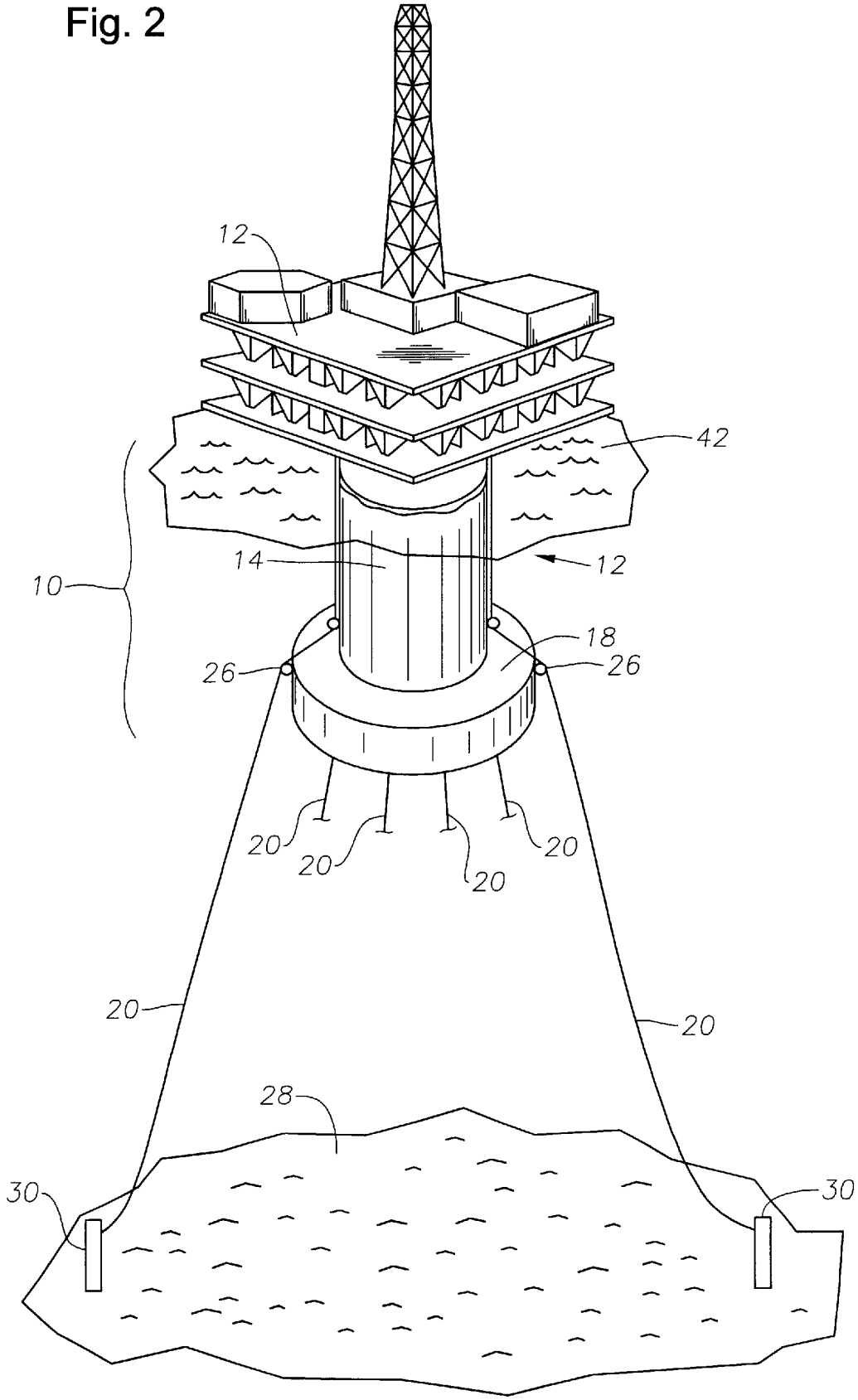
FIG. 2 is a schematic drawing showing an exemplary floating vessel constructed in accordance with the present invention being moored to the sea floor.

When the vessel is located at the location where it is desired to be installed, the lower flotation tanks 38 are flooded with water, causing the lower base section 18, as well as a portion of the tower section 16, to become disposed beneath the surface 42 of the water, as depicted in FIGS. 1, 2 and 6. When in this installed position, the vessels 10, 10' have a draft of about 250 feet or less.

Figure 7:
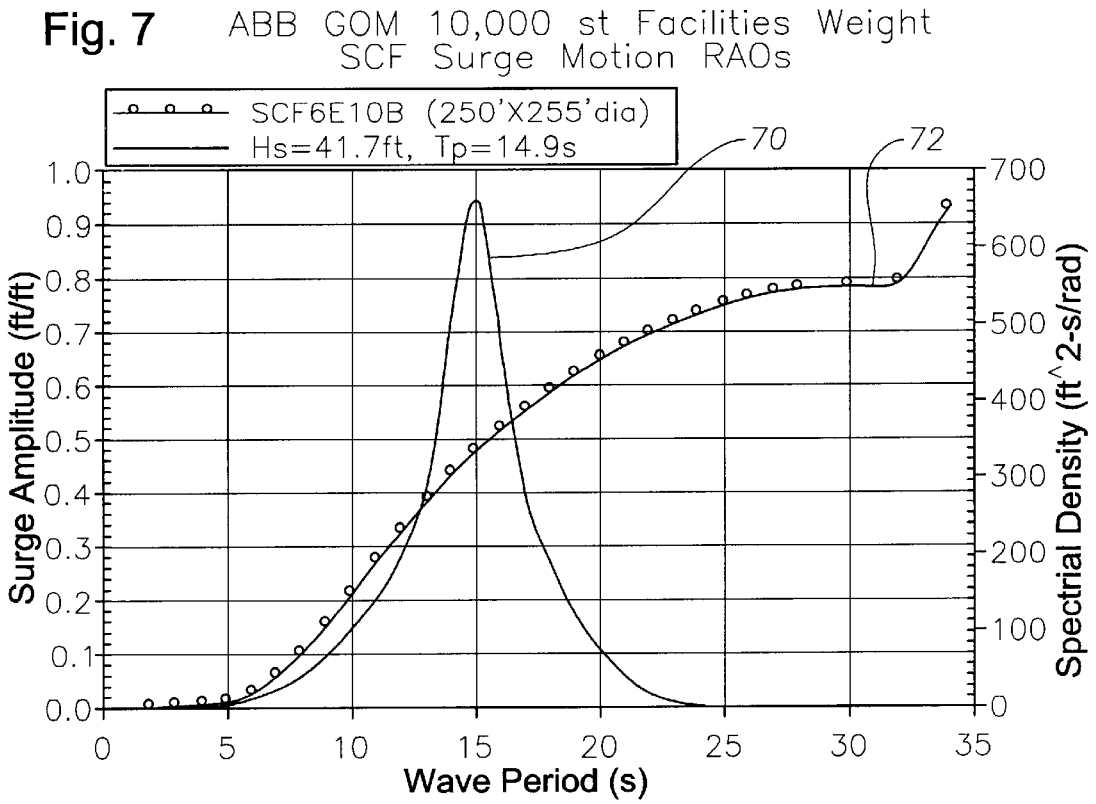
FIG. 7 illustrates schematically the surge response for an exemplary vessel constructed in accordance with the present invention.
Figure 8:
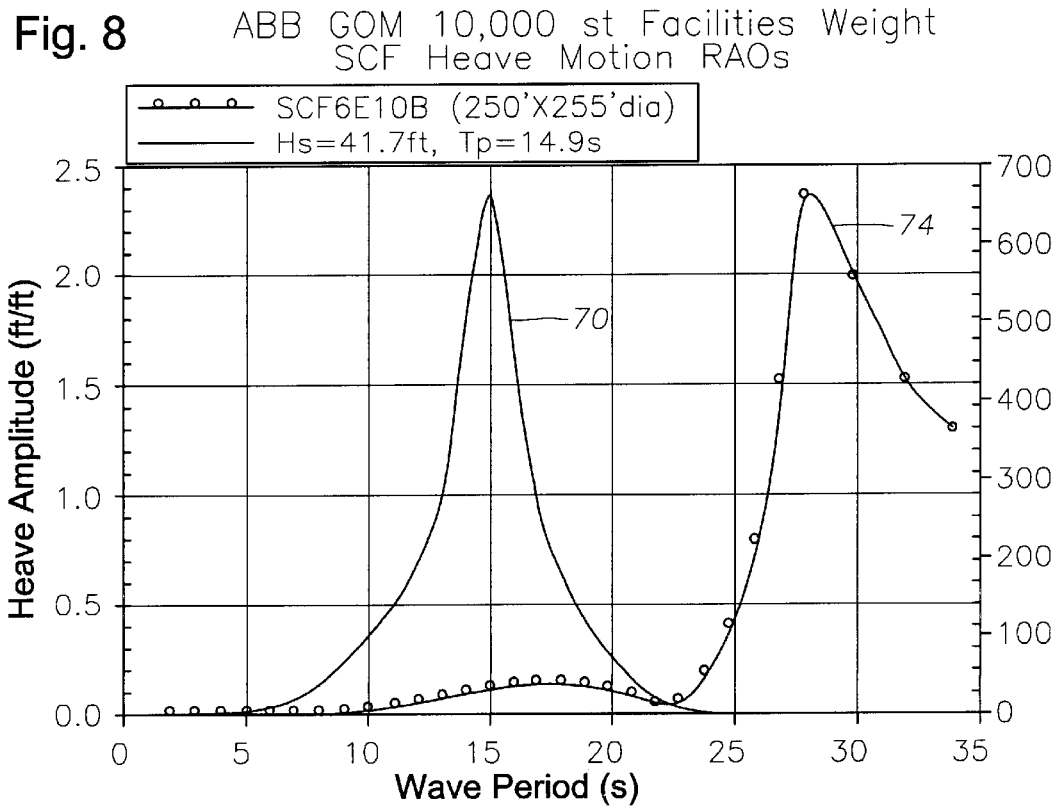
FIG. 8 illustrates schematically the heave response for an exemplary vessel constructed in accordance with the present invention.
Figure 9:
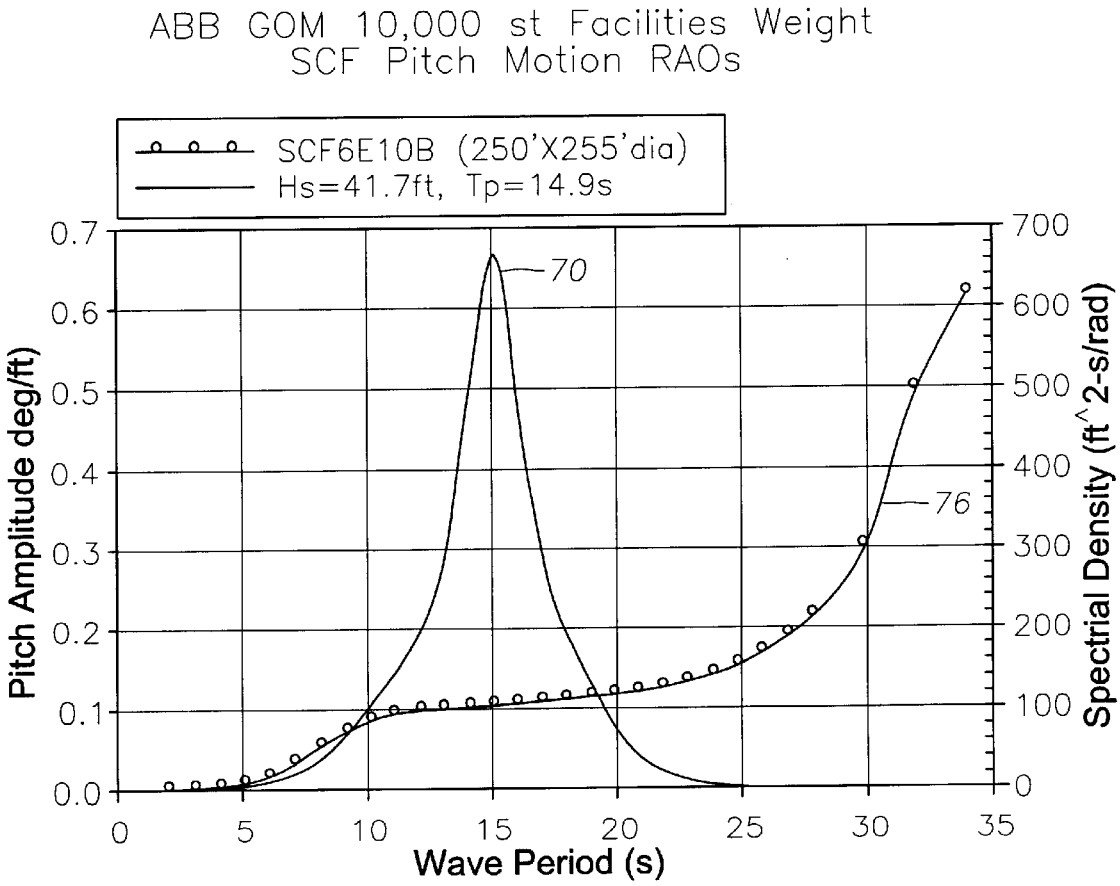
FIG. 9 illustrates schematically the pitch response for an exemplary vessel constructed in accordance with the present invention.

In the installed position, the vessel (10, 10') provides a stable platform that provides controlled harmonic responses to the dynamic loads of its environment produced by waves and swells in the sea. This can be seen graphically by reference to FIGS. 7, 8 and 9. Curve 70, in FIGS. 7, 8 and 9 represents a typical hurricane wave energy spectrum for conditions in the Gulf of Mexico, shown to be primarily in the range of about 12–18 seconds. The vessel's surge, heave and pitch response motions are shown by curves 72, 74 and 76 respectively. Curve 74 (FIG. 8) is indicative of the fact that vessel's dynamic period of around 25–30 seconds for heave is significantly longer than the peak wave energy. The vessel should remain stable since the harmonic responses to the environmental force are substantially removed from the periods of the exciting waves.

It will be apparent to those skilled in the art that modifications, changes and substitutions may be made to the invention shown in the foregoing disclosure. Accordingly, it is appropriate that the appended claims be construed broadly and in the manner consisting with the spirit and scope of the invention herein.

What is claimed is:

1. A floatable vessel for supporting structures for deep-water offshore well operations, comprising:

an upper vertically elongated tower section to support petroleum production facilities and having a first diameter, the tower section containing a flotation tank therein that is fixed against axial movement relative to the tower section; and a lower base section affixed to the upper tower section and having a second diameter that is greater than the first diameter.

2. The vessel of claim 1 further comprising a flotation tank in the lower base section.

3. The vessel of claim 1 further comprising a connector to secure a mooring line to an outer radial portion of the lower base section.

4. The vessel of claim 1 wherein the upper tower section is substantially cylindrical.

5. The vessel of claim 1 wherein the upper tower section comprises a plurality of substantially vertically oriented columns braced with cross members and the vessel has an installed position wherein the vessel is floating.

6. The vessel of claim 1 further comprising weighted ballast within the lower base section.

7. The vessel of claim 6 wherein the lower base section has a horizontal inner floor and the ballast is horizontally distributed upon the floor.

8. The vessel of claim 1 further comprising a central interior chamber defined within the tower section and the base section to contain at least one riser.

9. The vessel of claim 8 further comprising a support platform within the chamber through which said riser is disposed.

10. The vessel of claim 9 further comprising a motion dampener securing the riser to the support platform.

11. A floatable vessel for supporting rig structures for offshore well operations within a body of water, comprising:

an upper hull section to support rig structures a flotation tank within the upper hull section that is fixed against axial movement relative to the upper hull section; and a lower hull section having at least one flotation tank that, when filled with air, disposes the upper hull section and a portion of the lower hull section above the water line of an external body of water, and, when filled with water, disposes the lower hull section and a portion of the upper hull section below the water line of an external body of water.

12. The vessel of claim 11 wherein the lower hull section has a diameter that is larger than that of the upper hull section.

13. The vessel of claim 12 wherein the upper hull section is substantially cylindrically shaped.

14. The vessel of claim 11 further comprising a flotation tank in the upper hull section.

15. The vessel of claim 11 further comprising ballast in the lower hull section.

16. The vessel of claim 11 further comprising a motion dampener that operably interconnects at least one riser to the vessel.

17. The vessel of claim 16 wherein the pneumatic dampener and riser are contained within a central chamber defined within the vessel.

18. A floatable vessel for supporting structures for deep-water offshore well operations, comprising:

an upper vertically elongated tower section, having a vertical length, to support petroleum production facilities and consisting essentially of a first diameter;

a lower base section affixed to the upper tower section and consisting essentially of a second diameter that is greater than the first diameter;

a flotation tank that extends substantially all along the vertical length of the upper tower section.

19. The vessel of claim 18 further comprising a flotation tank in the lower base section.

20. The floatable vessel of claim 19 wherein the lower base section further comprises a horizontal inner floor with weighted ballast horizontally distributed upon the floor.

21. A floatable vessel for supporting structures for deep-water offshore well operations, comprising:

an upper vertically elongated tower section to support petroleum production facilities and having a first diameter;

a lower base section affixed to the upper tower section and having a second diameter that is greater than the first diameter;

a flotation tank in the lower base section that may be selectively flooded to move the floating vessel between a first, transport configuration, wherein the tower section and a portion of the lower base section are not submerged, and a second, installed configuration wherein the lower base section is submerged and floating; and a flotation tank disposed above the lower base section in fixed, non-moveable relation thereto.

22. A floatable vessel for supporting structures for deep-water offshore well operations, comprising:

a reduced diameter tower section to support petroleum production facilities, and defining a first flotation tank therein that is fixed against axial movement relative to the tower section;

an enlarged diameter base section affixed to the tower section;

a second flotation tank that can be selectively flooded to move the vessel between a first floating position used for transport, wherein the tower section and a portion of the base section are not submerged, and second floating position wherein the base section is submerged and not subjected to significant wave action.

23. A floatable vessel of claim 22, wherein the flotation tank contains a floor having weighted ballast distributed thereupon.

* * * * *